US006520256B2

(12) United States Patent
Ferg

(10) Patent No.: US 6,520,256 B2
(45) Date of Patent: Feb. 18, 2003

(54) METHOD AND APPARATUS FOR CEMENTING AN AIR DRILLED WELL

(76) Inventor: Thomas E. Ferg, 5525 Hwy. 64, Farmington, NM (US) 87401

( * ) Notice: Subject to any disclaimer, the term of this patent is extended or adjusted under 35 U.S.C. 154(b) by 96 days.

(21) Appl. No.: 09/839,521

(22) Filed: Apr. 20, 2001

(65) Prior Publication Data

US 2002/0153138 A1 Oct. 24, 2002

(51) Int. Cl.[7] ..... E21B 33/14

(52) U.S. Cl. ..... 166/285; 175/71; 166/317; 166/325; 166/327; 166/117.4

(58) Field of Search ..... 175/71; 166/316, 166/317, 325, 327, 177.4, 285

(56) References Cited

U.S. PATENT DOCUMENTS

| | | | | |
|---|---|---|---|---|
| 3,032,050 A | * | 5/1962 | Clark | 137/493.9 |
| 3,196,946 A | * | 7/1965 | Lauffer | 166/285 |
| 3,385,370 A | * | 5/1968 | Knox | 137/515 |
| 4,067,358 A | | 1/1978 | Streich | |
| 4,474,241 A | | 10/1984 | Freeman | |
| 4,589,495 A | | 5/1986 | Langer et al. | |
| 4,655,247 A | | 4/1987 | Westra et al. | |
| 5,131,473 A | * | 7/1992 | Fischer | 166/152 |

OTHER PUBLICATIONS

Product Specification Sheet, Weatherford, Inc. Model 1406 Auto–Fill Flapper Float Collar (1993).

* cited by examiner

*Primary Examiner*—David Bagnell
*Assistant Examiner*—Robert D Jones
(74) *Attorney, Agent, or Firm*—Kameron D. Kelly

(57) ABSTRACT

A downhole cementing system employing a cement choke within the casing to reduce the downward velocity of cement through the casing and thereby inhibit formation fracturing caused by vibration of the casing. The cement choke includes a tubular body defining a fluid passageway, a seat coupled to the tubular body and defining a seat orifice, a choke element coupled to the seat and restricting flow through the seat orifice, and a check valve coupled to the seat and operable to substantially block fluid flow through the seat orifice.

40 Claims, 3 Drawing Sheets

METHOD AND APPARATUS FOR CEMENTING AN AIR DRILLED WELL

BACKGROUND OF THE INVENTION

1. Field of the Invention

The present invention relates generally to systems for cementing casing in a wellbore. In a further aspect, this invention relates to a system for reducing formation fracturing when cementing casing in an air drilled wellbore.

2. Discussion of Prior Art

During the construction of oil and gas wells a borehole is drilled to a certain depth. The drill string is then removed and casing is inserted into the borehole. After insertion of the casing into the borehole, cement slurry is pumped down through the casing and up into the space, or annulus, between the outside of the casing and the wall of the borehole. The cement slurry, upon setting, stabilizes the casing in the wellbore, prevents fluid exchange between or among formation layers through which the wellbore passes, and prevents gas from rising up the wellbore.

Casing which is lowered into the borehole is typically equipped with a check valve mounted on or adjacent to the bottom of the casing. The check valve is incorporated into a device commonly known as either a float collar or a float shoe. If the device is located on the end of the casing string it is generally referred to as a float shoe. If the device is located between adjacent joints of casing it is generally referred to as a float collar. During cementing of the casing, the check valve permits cement to flow downward through the casing and out into the annulus, but prevents back flow of cement from the annulus into the casing.

During lowering of the casing into the borehole, it is frequently necessary to open the check valve in order to allow fluid to flow upwardly therethrough. The need for opening the check valve during lowering of the casing into the borehole is caused by the presence of liquid-phase fluids in the borehole which exert an upward buoyancy force on the casing that is sufficient to float the casing in the borehole. Such liquid-phase fluids may include drilling mud and/or other wellbore fluids which are typically present in a borehole drilled using liquid-based drilling fluids.

In an air-drilled wellbore, however, the borehole is typically devoid of liquid-phase fluids which would be sufficient to float the casing. Rather, an air-drilled borehole typically contains primarily gas-phase fluids. Thus, when casing equipped with a check valve is lowered into an air-drilled borehole, it is not necessary to open the check valve and permit upward fluid flow into the casing in order prevent floating of the casing. In fact, in a air-drilled borehole it is undesirable to allow such upward fluid flow through the casing because the upward flow of gas-phase fluids through the casing may present a fire hazard at the top of the casing.

One problem encountered when cementing casing in an air-drilled wellbore is that the cement charged to the top of the casing free-falls downward through the gas-phase fluids in the casing. Because these gas-phase fluids provide only minimal resistance to the downward flow of the cement through the casing, the velocity of the cement falling through the casing can reach excessively high levels. When the high velocity cement reaches the bottom of the casing, it can cause large pressure surges which are transferred to the rock matrix. Pressure surge is undesirable because it can cause fracturing of the subterranean formation.

SUMMARY OF THE INVENTION

In accordance with an embodiment of the present invention, a wellbore cementing method is provided. The cementing method comprises the steps of: (a) lowering a casing into a borehole which contains fluids that are insufficient to float the casing; (b) charging cement to an upper end of the casing; and (c) restricting the downward flow of the cement through the casing with a cement choke.

In accordance with another embodiment of the present invention, a wellbore cementing method is provided. The wellbore cementing method comprises the steps of: (a) coupling a choke element to a float collar; (b) coupling the float collar between two adjacent joints of casing; (c) lowering the casing and the float collar into a borehole; (d) at least substantially blocking upper fluid flow through the float collar; (e) charging cement to the upper end of the casing so that the cement falls downward towards the float collar; and (f) contacting the cement with the choke element so that the velocity of the cement exiting the float collar is less than it would have been had step (a) not been performed.

In accordance with a further embodiment of the present invention a downhole choke couplable between two adjacent joints of wellbore casing is provided. The downhole choke comprises a tubular body, a seat, a choke element, and a check valve. The tubular body defines a fluid passageway. The seat is coupled to the tubular body and defines a seat orifice. The seat orifice is in fluid communication with the fluid passageway. The choke element is coupled to the seat and defines a choke orifice. The choke element is operable to at least partially inhibit fluid flow through the seat orifice in a first flow direction. The check valve is coupled to the seat and operable to at least substantially block fluid flow through the seat orifice in a second flow direction which is generally opposite the first flow direction.

In accordance with a still further embodiment of the present invention, a wellbore which has been readied for cementing is provided. The wellbore comprises a generally downwardly extending borehole, a casing string, and a cement choke. The casing string presents upper and lower ends and defines a fluid passageway therebetween. The casing string is disposed in the borehole and is at least substantially fixed relative to the borehole. The cement choke is coupled to the casing string below the upper end of the casing. The cement choke presents a flow restricting surface operable to at least partially inhibit the downward flow of cement through the fluid passageway and dampening pressure surges. The fluid passageway above the cement choke primarily contains gas-phase fluids.

In accordance with another embodiment of the present invention a method of making a downhole cement choke is provided. The downhole cement choke is made by modifying a conventional float collar which includes a seat presenting a seat opening and a check valve coupled to the seat and operable to provide one-way flow through the seat orifice. The seat defines a surface into which a conventional auto-fill valve can be mounted. The method of making the downhole cement choke comprises the steps of: (a) forming a choke element which defines a choke orifice having a flow area which is less than the flow area of the seat orifice; and (b) placing the choke element in registry with the surface which could hold the conventional auto-fill sleeve so that the choke element is spaced from the check valve.

The present invention provides a system for inhibiting the fracturing of subterranean formations when cementing casing in a wellbore. Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENT

Figure 1:
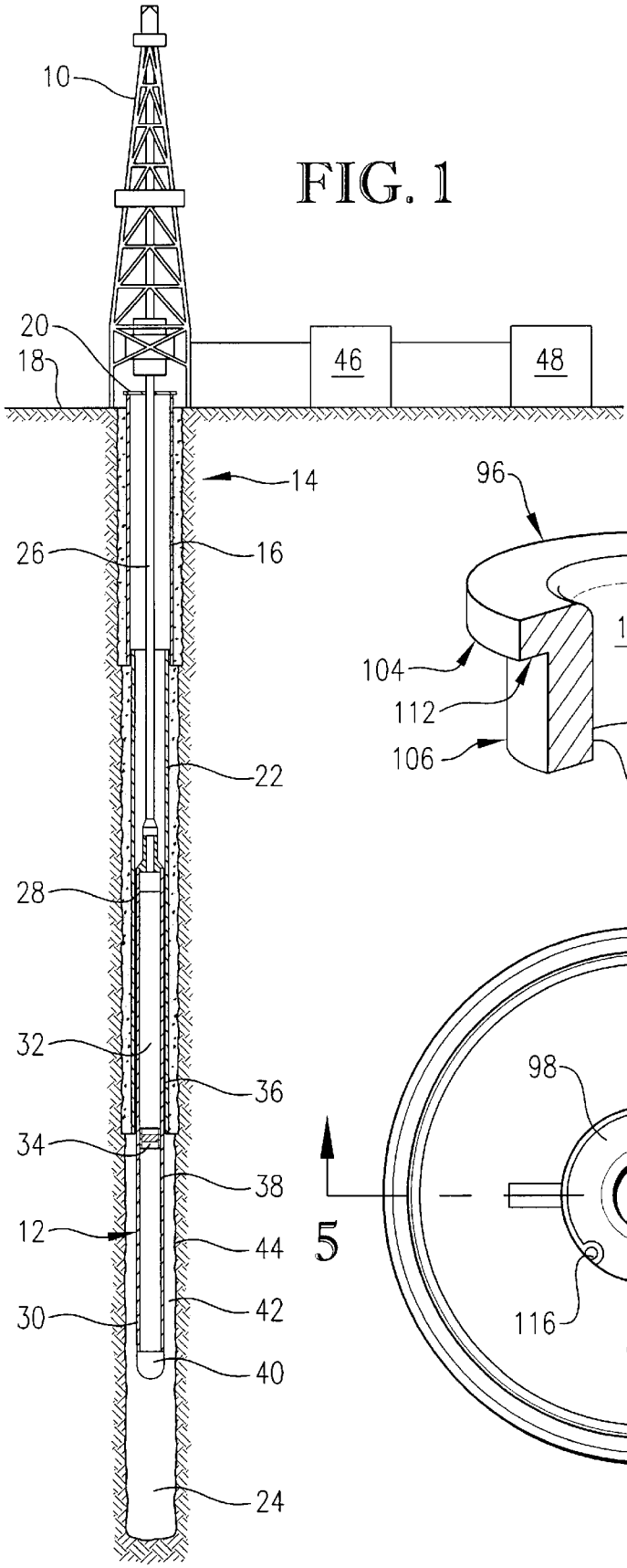
FIG. 1 is a side view showing a drilling rig lowering casing into a borehole.

FIG. 1 illustrates a drilling rig 10 lowering a length of uncemented casing 12 into a wellbore 14. Wellbore 14 includes a surface casing 16 extending generally downward from aground surface 18 and presenting a casing head 20 located proximate ground surface 18. Wellbore 14 is also shown as including an intermediate casing 22 located below surface casing 16. In FIG. 1, surface casing 16 and intermediate casing 22 are shown as having already been cemented in wellbore 14.

Positioned below intermediate casing 22 is a borehole 24 which has been drilled into a subterranean formation 26.

Casing 12 is lowered into borehole 24 via drilling rig 10 and a pipe 26. Casing 12 presents an upper end 28, a lower end 30, and a fluid passageway 32 extending therebetween. A cement choke 34 is coupled between an upper joint 36 of casing 12 and a lower joint 38 of casing 12. Casing 12 further includes a shoe 40 coupled to lower end 30 for guiding casing 12 through borehole 24. An annulus 42 is formed between the outside of casing 12 and a borehole wall 44.

When casing 12 is lowered to its desired depth in borehole 24, cement pump 46 can be actuated to pump cement slurry from a cement source 48 into wellbore 14. In wellbore 14, the cement travels downwardly through fluid passageway 32, out of casing 12 through shoe 40, and up into annulus 42.

In accordance with the present invention, prior to lowering casing 12 into borehole 24, borehole 24 preferably contains fluids which are insufficient to float casing 12. More preferably, borehole 44 contains primarily gas-phase fluids. Most preferably, borehole 24 contains substantially only gas-phase fluids. In order to obtain a borehole having the above-described properties, borehole 24 may be drilled using under balanced drilling techniques which employ low density circulating fluids. The circulating fluid used during drilling of borehole 24 preferably has a density of less than two pounds per gallon, more preferably less than one pound per gallon. Examples of suitable low density circulating fluids include air, nitrogen, natural gas, carbon dioxide, foams, mists, stiff foams, and aerated drilling fluids. Most preferably, bore hole 24 is air drilled with a primarily gas-phase drilling fluid such as, for example, air, natural gas, and/or nitrogen.

After drilling borehole 24 in accordance with the above described techniques, the fluids contained in borehole 24 are insufficient to float casing 12. Thus, because there is little resistance to the downward travel of casing 12 through borehole 24, there is no need to permit the fluids in borehole 24 to pass upwardly through fluid passageway 32 of casing 12. Further, because the fluids contained in borehole 24 may be combustible, it is preferred that the fluid is at least substantially blocked from upward flow through fluid passageway 32 when casing 12 is being lowered into borehole 24. If upward fluid flow is not blocked, a fire hazard may be created at the base of drilling rig 10.

Blocking upward flow through fluid passageway 32 during the lowering of casing 12 in borehole 24 results in fluid passageway 32 containing primarily gas-phase fluids when casing 12 is positioned for cementing. In such an arrangement, cement charged to upper end 28 of casing 12 is subjected to substantially free-fall conditions above cement choke 34. In accordance with the present invention, cement choke 34 is operable to reduce the velocity of the cement falling through fluid passageway 32 and thereby reduce pressure being transferred external to the casing.

Figure 2:
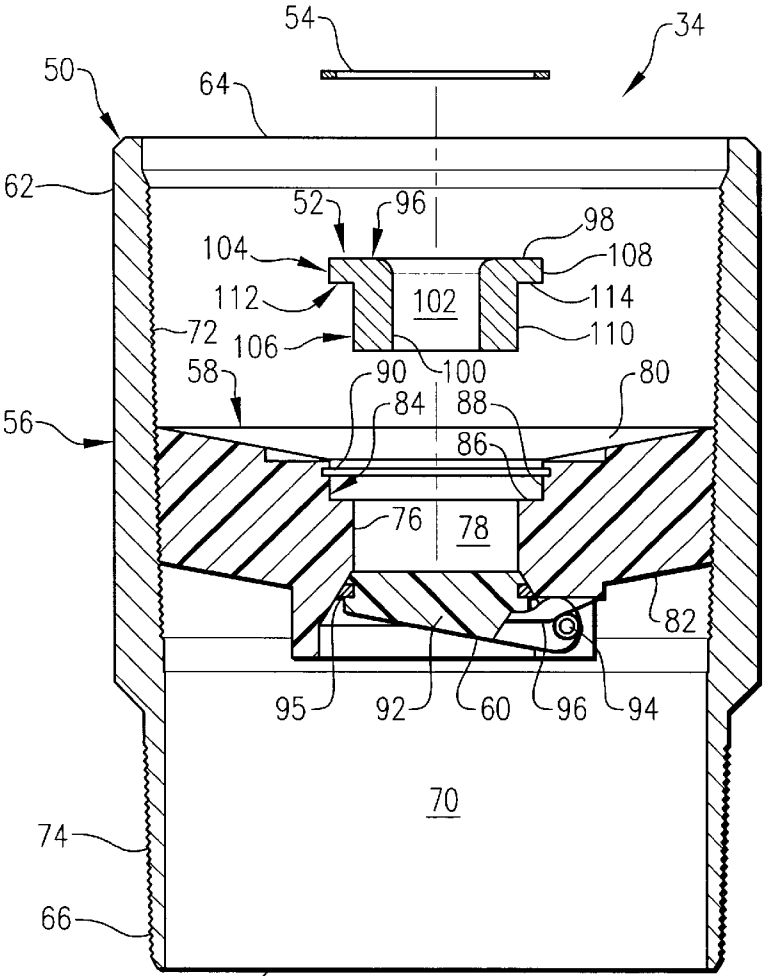
FIG. 2 is an assembly view of a downhole cement choke.

FIG. 2 shows the components and construction of cement choke 34 in detail. Choke 34 generally comprises a float collar 50, a choke element 52, and a resilient ring 54 for coupling choke element 52 to float collar 50.

Float collar 50 includes a tubular body 56 supporting a seat 58 which is coupled to a check valve 60. Tubular body 56 includes an upper end 62 presenting an upper opening 64 and a lower end 66 presenting a lower opening 68. Tubular body 56 defines a flow passageway 70 extending between upper opening 64 and lower opening 68. Tubular body 56 is couplable between two adjacent joints of casing via internal threads 72 on upper end 62 and external threads 74 on lower end 66. Tubular body 56 is composed of any suitably strong material, such as, for example, steel.

Seat 58 is fixedly coupled to tubular body 56. Seat 58 can be formed within tubular body 56 or can be manufactured separate from tubular body 56 and then threaded into tubular body 56 via internal threads 72. Seat 58 is generally disposed in flow passageway 70 and presents an inner seat wall 76. Inner seat wall 76 defines a seat orifice 78 which is in fluid communication with flow passageway 70. Seat orifice 78 has a flow area which is generally less than the flow area of flow passageway 70. As used herein, the term "flow area" shall mean the cross-sectional area of an opening through which fluid may flow, with the cross-section being taken along a plane which is generally perpendicular to the direction of flow through the opening. Preferably, seat orifice 78 has a flow area which is less than fifty-percent of the flow area of flow passageway 70. Most preferably. seat orifice 78 has a flow area which is less than twenty-five percent of the flow area of flow passageway 70. Seat 58 can be made of any suitable strong material, such as, for example, aluminum or fiber-reinforced cement. Seat 58 includes an upper portion 80 to which choke element 52 may be coupled and a lower portion 82 to which check valve 60 may be coupled.

Upper portion 80 presents a mounting recess 84 located adjacent inner seat wall 76. Mounting recess 84 includes a generally horizontal surface 86 and a generally vertical surface 88. Vertical surface 88 is interrupted by a slot 90 formed therein. Slot 90 is adapted to receive resilient ring 54 when choke element 52 is mounted on seat 58.

Check valve 60 is operable to at least substantially block upward fluid flow through seat orifice 78 while permitting downward fluid flow through seat orifice 78. Check valve 60 is shiftable between an open position during which fluid flow through seat orifice 78 is permitted and a closed position during which fluid flow through seat orifice 78 is at least substantially blocked. Check valve 60 is preferably a flapper-type valve including a flapper body 92 which is pivotally coupled to lower portion 82 of seat 58 by a hinge 94. Check valve 60 is biased towards the closed position in which flapper body 92 substantially covers seat orifice 78. In the closed position, flapper body 92 substantially sealingly contacts lower portion 82 of seat 58 with an 0-ring seal 95.

A spring 96 located proximate hinge 94 urges check valve 60 toward the closed position. Float collar 50 can be a commercially available flapper float collar, such as, for example, a Model 1406 Auto-fill Flapper Float Collar available from Weatherford Inc., Houma, La. Choke element 52, described in detail below, can be mounted on seat 58 in place of a conventional auto-fill sleeve. The conventional auto-fill sleeve is replaced by choke element 52 because the auto-fill sleeve undesirably holds check valve 60 in the open position while the casing is being lowered into the borehole. Further, the conventional auto-fill sleeve is likely to be incapable of acting as a cement choke because its flanges which mount it to the seat may not be durable enough to withstand the impact of cement free-falling through a substantial length of casing.

Figure 3:
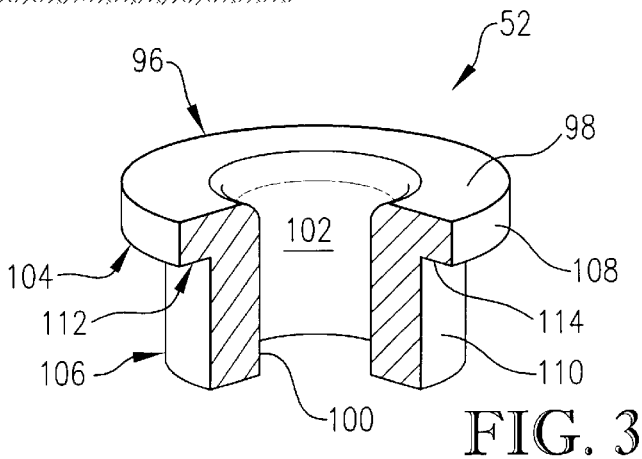
FIG. 3 is an isometric view of a choke element with certain sections being cut away.

As perhaps best illustrated in FIG. 3, choke element 52 includes a generally hollow body 96 presenting an upper flow restricting surface 98 and an inner cylindrical surface 100 which defines a choke orifice 102. Choke orifice 102 has a flow area which is generally less than the flow area of seat orifice 78. Preferably, choke orifice 102 has a flow area which is less than twenty-five percent of the flow area of flow passageway 70. Most preferably, choke orifice 102 has a flow area which is less than fifteen percent of the flow area of flow passageway 70. Body 96 includes an upper annular portion 104 and a lower annular portion 106. Upper annular portion 104 presents lower circumferential surface 108 and lower annular portion 106 presents upper circumferential surface 110. The outside diameter of upper annular portion 104 is greater than the outside diameter of lower annular portion 106 to thereby form a mounting flange 112. Mounting flange 112 presents a lower mounting surface 114 extending between upper circumferential surface 108 and lower circumferential surface 110. Choke element 52 can be made of any suitable material which is strong enough to withstand the impact of falling cement without breaking mounting flange 112. Preferably, choke element 52 is formed of aluminum.

Figure 4:
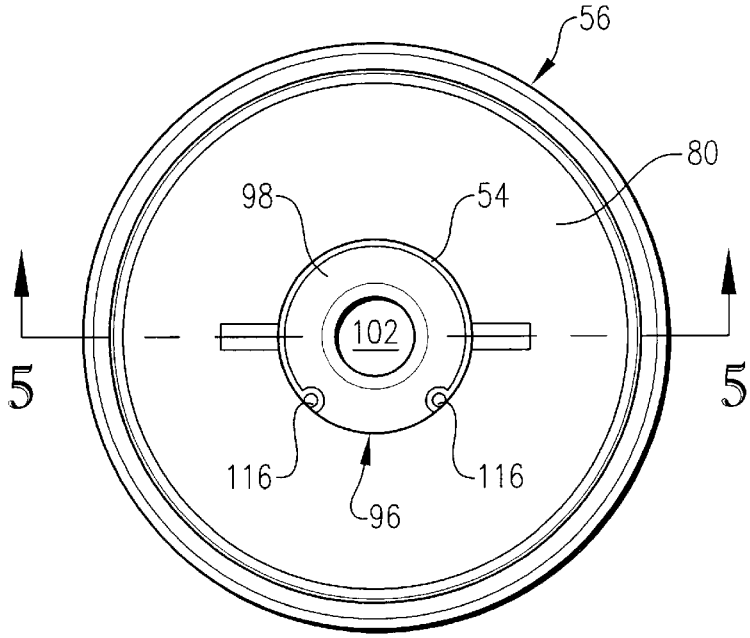
FIG. 4 is a top view of a downhole cement choke.

As perhaps best seen in FIG. 2, choke element 52 can be mounted on seat 58 by positioning mounting flange 112 in registry with mounting recess 84 and then inserting resilient ring 54 into slot 90. FIG. 4 shows that a portion of ring 54 extends over flow restricting surface 98 to thereby restrain movement of choke element 52 relative to seat 58. Ring 54 has a generally C-shape and includes a pair of openings 116 at its ends for inserting and removing ring 54 from slot 90. Ring 54 can be made of any suitably strong and resilient material such as, for example, steel.

Figure 5:
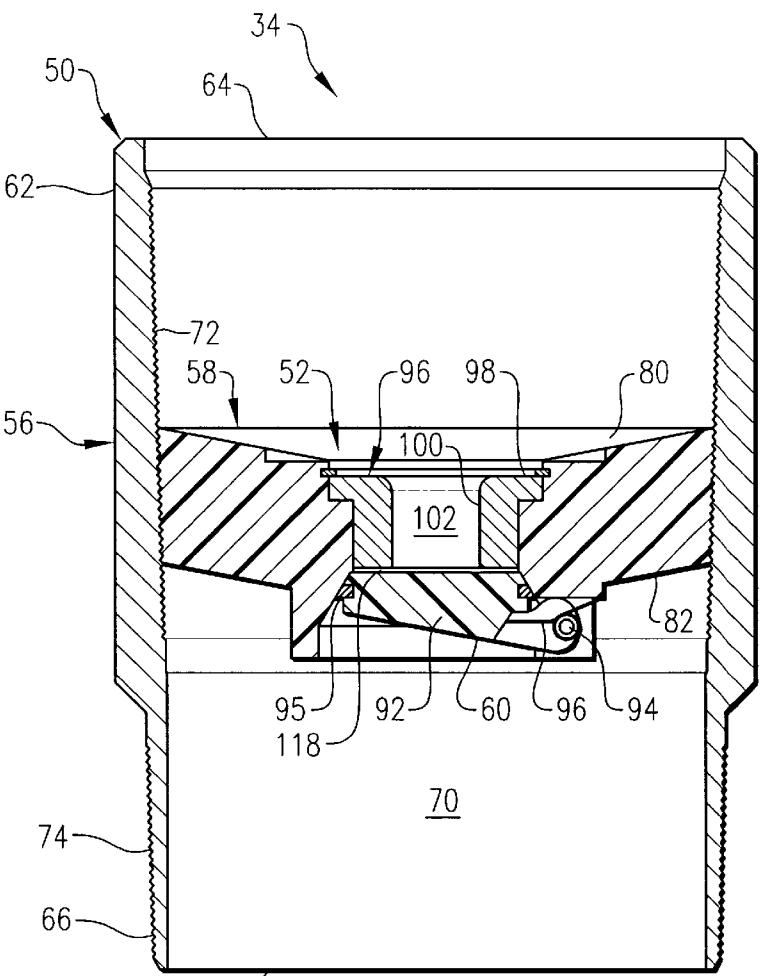
FIG. 5 is a cross-sectional view of a downhole cement choke taken along lines 5—5 in FIG. 4.

FIG. 5 shows choke element 52 mounted on seat 58 and restrained from movement by ring 54. FIG. 5 illustrates that choke element 52 is spaced from check valve 60 by a gap 118 and therefore does not interfere with the operation of check valve 60.

Figure 6:
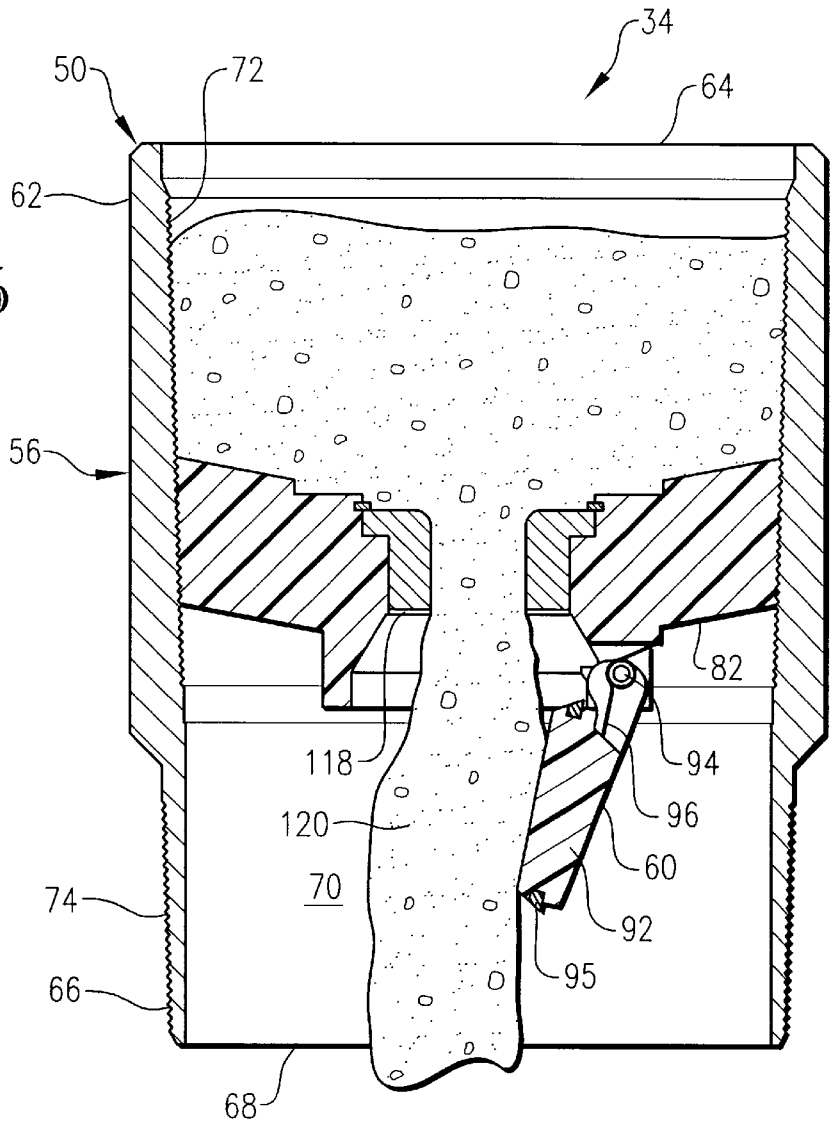
FIG. 6 is a cross-sectional view of a downhole cement choke showing cement flowing therethrough.

FIG. 6 shows check valve 60 in the open position with cement 120 flowing through choke orifice 102. As can be seen in FIG. 6, all cement 120 passing through cement choke 34 must pass through choke orifice 102.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A wellbore cementing method comprising the steps of:

(a) lowering a casing into a borehole which contains fluids that are insufficient to float the casing;

(b) charging cement to an upper end of the casing; and (c) restricting the downward flow of the cement through the casing with a cement choke, said cement choke including a seat which defines a seat orifice, said seat orifice having a flow area which is less than the minimum flow area of the casing above the cement choke, said cement choke including a choke element coupled to the seat and defining a choke orifice, said choke orifice having a flow area which is less than the flow area of the seat orifice.

2. A cementing method as claimed in claim 1; and (d) at all points during which step (a) is being performed, at least substantially blocking upward fluid flow through the casing.

3. A cementing method as claimed in claim 1; and (e) between the upper end of the casing and the cement choke, subjecting the cement in the casing to substantially free-fall conditions through primarily gas-phase fluids.

4. A cementing method as claimed in claim 3, said cement choke operable to reduce the velocity of the cement to a velocity which is less than the maximum velocity of the cement falling through the casing above the cement choke.

5. A cementing method as claimed in claim 1, at all points during which step (a) is being performed, said cement choke contacting primarily gas-phase fluids.

6. A cementing method as claimed in claim 1; and (f) coupling the cement choke between two adjacent joints of casing.

7. A cementing method as claimed in claim 6, said cement choke including a check valve which at least substantially blocks upward fluid flow through the cement choke and allows downwardly flowing cement to pass therethrough.

8. A wellbore cementing method comprising the steps of:

(a) lowering a casing into a borehole which contains fluids that are insufficient to float the casing;

(b) charging cement to an upper end of the casing;

(c) restricting the downward flow of the cement through the casing with a cement choke; and (d) coupling the cement choke between two adjacent joints of casing, said cement choke including a check valve which at least substantially blocks upward fluid flow through the cement choke and allows downwardly flowing cement to pass therethrough, said cement choke including a seat which defines a seat orifice, said seat orifice having a flow area which is less than the minimum flow area of the casing above the cement choke, said cement choke including a choke element coupled to the seat and defining a choke orifice, said choke orifice having a flow area which is less than the flow area of the seat orifice.

9. A wellbore cementing method comprising the steps of:

(a) coupling a choke element to a seat of a float collar, said choke element defining a choke orifice extending through the choke element;

(b) coupling the float collar between two adjacent joints of casing;

(c) lowering the casing and the float collar into a borehole;

(d) at all points during which step (c) is being performed, at least substantially blocking upward fluid flow through the float collar;

(e) charging cement to an upper end of the casing so that the cement falls downward towards the float collar; and (f) contacting the cement with the choke element and passing the cement through the choke orifice so that the velocity of the cement exiting the float collar is less that it would have been had step (a) not been performed.

10. A cementing method as claimed in claim 9, during step (c), said casing primarily displacing gas-phase fluids.

11. A cementing method as claimed in claim 9, during step (c), said casing displacing substantially only gas-phase fluids.

12. A cementing method as claimed in claim 9, during step (e), said cement falling towards the float collar primarily falls through gas-phase fluids.

13. A cementing method as claimed in claim 9, during step (e), said cement falling towards the float collar falls through substantially only gas-phase fluids.

14. A cementing method as claimed in claim 9; and (g) drilling the borehole using a non-liquid based drilling fluid.

15. A cementing method as claimed in claim 14, between steps (g) and (c), said borehole primarily containing gas-phase fluids.

16. A cementing method as claimed in claim 14; and between steps (g) and (c), said borehole containing substantially only gas-phase fluids.

17. A cementing method as claimed in claim 9; and during step (c) said borehole containing fluids which exert a cumulative upward buoyancy force on the casing, said upward buoyancy force being less than the weight of the casing.

18. A downhole choke couplable between two adjacent joints of wellbore casing, said choke comprising:

a tubular body defining a fluid passageway;

a seat coupled to the tubular body and defining a seat orifice, said seat orifice being in fluid communication with the fluid passageway;

a choke element coupled to the seat and defining a choke orifice, said choke element operable to at least partially inhibit fluid flow through the seat orifice in a first flow direction; and a check valve coupled to the seat and operable to at least substantially block fluid flow through the seat orifice in a second flow direction generally opposite the first flow direction.

19. A choke as claimed in claim 18, said choke element being spaced from said check valve.

20. A choke as claimed in claim 18, said seat orifice having a flow area which is less than that of the fluid passageway, said choke orifice having a flow area which is less than that of the seat orifice.

21. A choke as claimed in claim 20, said seat orifice having a flow area which is less than 50% of that of the fluid passageway, said choke orifice having a flow area which is less than 25% of that of the fluid passageway.

22. A choke as claimed in claim 21, said seat orifice having a flow area which is less than 25% of that of the fluid passageway, said choke orifice having a flow area which is less than 15% of that of the fluid passageway.

23. A choke as claimed in claim 18, said choke element presenting a flow restricting surface extending at least substantially perpendicular to the first flow direction.

24. A choke as claimed in claim 23, said flow restricting surface at least partially covering the seat orifice.

25. A choke as claimed n claim 24, said choke orifice extending through the choke element generally in the first flow direction.

26. A choke as claimed in claim 25, said choke element at least partially disposed in the seat orifice.

27. A choke as claimed in claim 26, said choke element presenting a substantially cylindrical inner surface which defines the choke orifice.

28. A choke as claimed in claim 27, said choke element presenting an outer mounting flange, said seat defining an inner mounting recess adjacent the seat orifice, said mounting flange being received in registry with the mounting recess.

29. A choke as claimed in claim 28, said seat defining a slot located proximate the flow restricting surface.

30. A choke as claimed in claim 29; and a yieldable ring received in the slot and operable to restrain movement of the coke element relative to the seat.

31. A choke as claimed in claim 18, said check valve shiftable between a closed position for at least substantially blocking fluid flow through the seat orifice and an open position for permitting fluid flow through the seat orifice, said check valve including a biasing mechanism for urging the check valve towards the closed position.

32. A choke as claimed in claim 31, said biasing mechanism maintaining the check valve in the closed position unless fluid is flowing through the seat orifice in the first direction.

33. A choke as claimed in claim 32, said check valve including a flapper body pivotally coupled to the seat, said flapper body presenting a sealing surface which at least substantially sealingly contacts the seat when the check valve is in the closed position.

34. A wellbore casing system which has been readied for cementing, said wellbore casing system comprising:

a borehole wall defining a generally downwardly extending borehole;

a casing string at least substantially disposed in the borehole and at least substantially fixed relative to the borehole wall, said casing string presenting upper and lower ends and defining a fluid passageway; and a cement choke coupled to the casing string below the upper end, said cement choke presenting a flow restricting surface operable to at least partially inhibit the downward flow of cement through the fluid passageway, said fluid passageway above the choke primarily containing gas-phase fluids, said cement choke including a seat which defines a seat orifice, said seat orifice having a flow area which is less than the minimum flow area of the casing above the cement choke, said cement choke including a choke element coupled to the seat and defining a choke orifice, said choke orifice having a flow area which is less than the flow area of the seat orifice.

35. A wellbore casing system as claimed in claim 34, said cement choke including a check valve for at least substantially blocking the upward flow of fluid through the seat orifice and permitting the downward flow of cement through the seat orifice.

36. A wellbore casing system as claimed in claim 35, said flow restricting surface extending substantially perpendicular to the direction of fluid flow through the fluid passageway.

37. A wellbore casing system as claimed in claim 34, said borehole wall and said casing cooperatively defining an annulus therebetween, said annulus primarily containing gas-phase fluids.

38. A wellbore casing system as claimed in claim 37, said annulus containing substantially only gas-phase fluids.

39. A method of making a downhole cement choke from a float collar, said float collar including a seat presenting a seat opening and a check valve coupled to the seat and operable to provide one-way flow through the seat orifice, said seat defining a valve mounting surface on which an auto-fill valve can be mounted, said method of making comprising the steps of:

(a) forming a choke element which defines a choke orifice having a flow area which is less than the flow area of the seat orifice; and (b) placing the choke element in registry with the valve mounting surface so that the choke element is spaced from the check valve.

40. A method as claimed in claim 39; and (c) insering a resilient ring into a slot defined by the seat to thereby restrain movement of the choke element relative to the seat.

* * * * *

UNITED STATES PATENT AND TRADEMARK OFFICE

CERTIFICATE OF CORRECTION

PATENT NO. : 6,520,256 B2 
DATED : February 18, 2003
INVENTOR(S) : Ferg, Thomas E.

It is certified that error appears in the above-identified patent and that said Letters Patent is hereby corrected as shown below:

Title page,
Add as follows -- [73] Assignee: Phillips Petroleum Company, Bartlesville, OK (US) --.

Signed and Sealed this

Thirteenth Day of May, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,520,256 B2 
DATED : February 18, 2003
INVENTOR(S) : Thomas E. Ferg It is certified that error appears in the above-identified patent and that said Letters Patent is hereby corrected as shown below:

Column 8,
Line 35, delete “coke” and insert -- choke -- therefor.

Column 10,
Line 20, delete “insering” and insert -- inserting -- therefor.

Signed and Sealed this

Twenty-ninth Day of July, 2003

JAMES E. ROGAN
*Director of the United States Patent and Trademark Office*